US005205054A

United States Patent [19]

York, Jr.

[11] Patent Number: 5,205,054

[45] Date of Patent: Apr. 27, 1993

[54] ADJUSTABLE SANDAL

[76] Inventor: Harold D. York, Jr., 28610 Devils Punchbowl Rd., Pearlblossom, Calif. 93553

[21] Appl. No.: 884,144

[22] Filed: May 18, 1992

[51] Int. Cl.[5] ..... A43B 3/12

[52] U.S. Cl. ..... 36/11.5; 36/58.5

[58] Field of Search ..... 36/58.5, 11.5, 7.5, 36/7.6

[56] References Cited

U.S. PATENT DOCUMENTS

| | | | |
|---|---|---|---|
| 4,200,997 | 5/1980 | Scheinhaus et al. | 36/11.5 |
| 4,793,075 | 12/1988 | Thatcher | 36/11.5 |
| 4,817,302 | 4/1989 | Saltsman | 36/11.5 |
| 4,869,000 | 9/1989 | York, Jr. | 36/11.5 |
| 4,920,664 | 5/1990 | McGregor et al. | 36/11.5 |
| 5,056,241 | 10/1991 | Young | 36/11.5 |

FOREIGN PATENT DOCUMENTS

| | | | |
|---|---|---|---|
| 1028302 | 5/1953 | France | 36/11.5 |
| 1029166 | 6/1953 | France | 36/11.5 |

*Primary Examiner*—Steven N. Meyers
*Attorney, Agent, or Firm*—Edward A. Sokolski

[57] ABSTRACT

A sandal has separately adjustable toe and ankle strap assemblies. The toe strap assembly has a toe strap which is permanently secured at one end thereof to one side of the insole of the sandal. An anchor member is secured to the under surface of the insole at the side thereof opposite to that at which the strap is secured. This anchor member has an upright portion with a lateral slot formed therein, this upright portion being fitted in a slot in the insole and recessed below the upper surface of the insole. The toe strap is wrapped over the wearer's foot and slidably fitted through the slot in the anchor member and then folded over on itself, a hook-loop fastener installed on opposing strap portions being employed to firmly hold the strap in position. The heel strap assembly has a pair of straps, one of which wraps around the wearer's foot directly behind the instep, the other of which wraps around the wearer's heel. Both of these straps are permanently attached at one end thereof to one side of the insole. The other of the ends of the straps are looped through a ring secured to the other side of the insole and folded back on themselves. The opposing portions of the straps are secured in a desired position by hook-loop fasteners installed on such opposing portions.

6 Claims, 1 Drawing Sheet

ADJUSTABLE SANDAL

BACKGROUND OF THE INVENTION

1. Field of the invention.

This invention relates to an adjustable sandal and more particularly to such a sandal having adjustable toe and heel straps which can be used to secure the sandal to the wearer's foot.

2. Description of the related art.

Sandals have been designed which are suitable for hiking and running, such sandals generally having separate front straps and ankle straps to insure that the sandal does not inadvertently slip off the user's foot. A number of these prior art sandals have integrated front and ankle straps wherein the relative lengths of the front and ankle strap portions can be adjusted in length relative to each other to securely hold the sandal to the wearer's foot. Such sandals are described in U.S. Pat. No. 4,869,000 issued Sep. 26, 1989 to York and U.S. Pat. No. 4,793,075 issued Dec. 27, 1988 to Thatcher. The design of the York patent while suitable for ordinary walking does not provide as secure a binding for the portion of the foot immediately to the rear of the toes, as to be desired for hiking. Further, no separate adjustments for the toe and heel regions are afforded in this design. Thatcher, while providing separate toe and heel adjustments achieves this end result in the toe region by means of a ring member through which the toe and lateral side straps of the sandal are adjustably fitted. This ring member is of a hard rigid material which can, on occasion, irritate the sides of the user's foot. This type of member is also subject to breakage under the heavy wear encountered in strenuous hiking situations.

SUMMARY OF THE INVENTION

The sandal of the present invention overcomes the aforementioned shortcomings of the prior art in providing a sandal with separately adjustable toe and ankle straps wherein the toe strap does not employ an exposed hard ring member in the toe area. This end result is achieved by permanently securing one end of the toe strap to one side of the under portion of the insole and securing an anchor member to the opposite side of the under portion of the insole. The anchor member has an elongated slot formed therein through which the toe strap is slidably fitted, the entire anchor member being below the top surface of the insole. The toe strap bends over on itself and is secured in position by means of a hook and loop fastener material such as Velcro installed on the strap. A side strap interconnects the toe strap and the heel strap.

The heel strap assembly is anchored to the insole by means of a pair of cloth anchor members which are attached to the insole and extend upwardly therefrom. The heel strap assembly is formed by a pair of straps, one of which wraps around the wearer's foot directly behind the instep, the other of which wraps around the wearer's heel. Both of these straps are permanently attached at one of the ends thereof to one of the cloth anchor members while the other of the ends of such straps are looped through a ring member attached to the other of the cloth anchor members. These straps both are bent over on themselves and so secured in a desired position by means of a hook and loop material such as Velcro installed on opposing portions of each of the straps.

It is therefore an object of this invention to provide an improved sport sandal suitable for use in hiking and running.

It is a further object of this invention to provide an improved sport sandal in which there are no exposed hardware pieces in the toe area of such sandal.

Other objects of the invention will become apparent as the description proceeds in connection with the accompanying drawings.

DETAILED DESCRIPTION OF THE INVENTION

Figure 1:
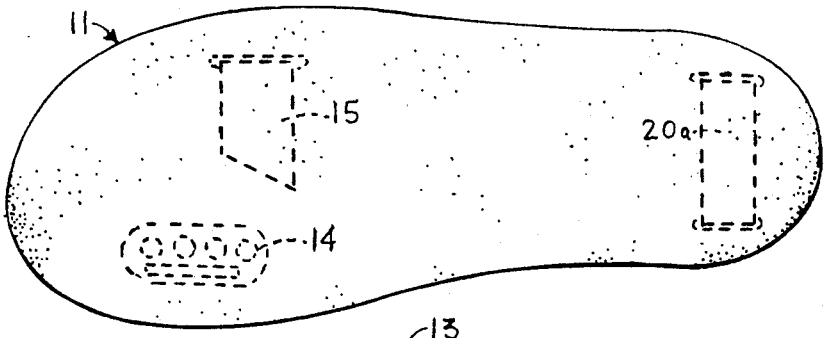
FIG. 1 is a bottom plan view of a preferred embodiment of the invention.
Figure 2:
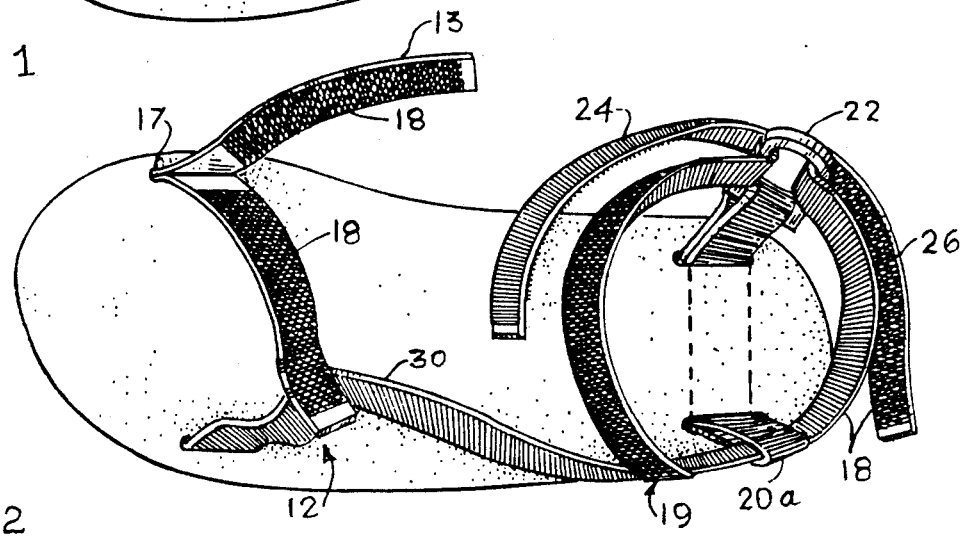
FIG. 2 is a top plan view of the preferred embodiment.
Figure 3:
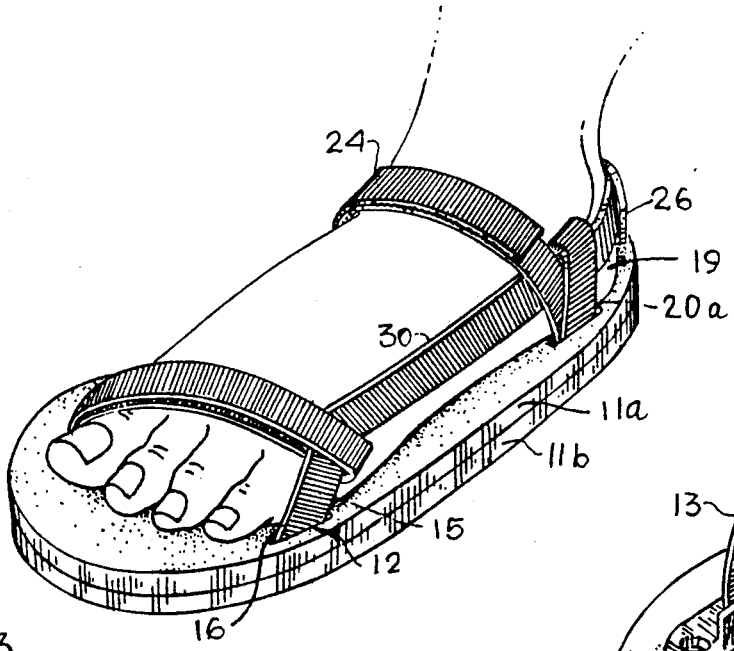
FIG. 3 is a front left side perspective view of the preferred embodiment.

Referring now to the drawings, a preferred embodiment of the invention is illustrated. The sandal has a relatively conventional sole portion 11. This sole portion includes an insole 11*a* and an outsole 11*b* which are cemented together after the straps and anchor members have been cemented to the under surface of insole 11*a*.

Figure 4:
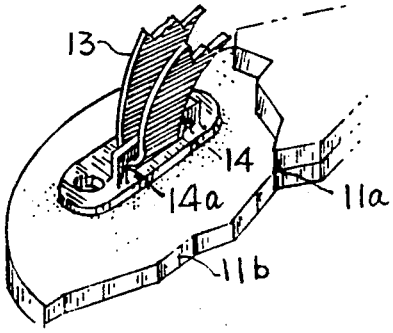
FIG. 4 is cutaway perspective view illustrating the anchor member of the preferred embodiment.

Toe strap assembly 12 is formed by a flexible strap 13 which is run through slot 14*a* formed in a vertically oriented portion of anchor member 14(see FIG. 4), this anchor member being cemented to the under surface of insole 11*a*. The upstanding portion of the anchor member in which slot 14*a* is located is fitted in slot 17 formed in the insole and extends to a point below the top surface of such insole. Cloth post member 15 is cemented to the under surface of the insole 11*a* and fits through a slot 16 formed in the insole. One end of strap 13 is stitched to post member 15. Portions of strap 13 have hook-loop fastening material 18, which may be Velcro fasteners, attached thereto.

In securing the toe strap to the wearer's foot, the free end of strap 13 is drawn through slot 14*a* of anchor member 14 until the strap firmly secures the toe portion of the wearer's foot to the sandal. The strap is then folded over on itself and hook-loop fasteners 18, which are attached to opposing portions of the strap joined together to secure the strap in position.

Ankle strap assembly 19 has a pair of similar post members 20*a* and 20*b* which are joined together on one end and cemented at this end to the under surface of insole 11*a*. Post member 20*b* has a loop formed therein in which ring 22 is installed. Strap 24 is attached at one end thereof to post member 20*b*, the other end of this strap being fitted through ring 22 and folded back on itself. Hook-loop fastening material 18, which may be a Velcro fastener, is attached to the opposing portions of strap 24 so that the strap can be drawn securely around the portion of the wearer's foot directly behind the instep and the hook-loop fastener then joined together.

Strap 26 is fastened at one end to post member 20*a* with the other end therefor being run through ring 22. This strap is run around the wearer's heel and folded back on itself. Hook-loop material such as a Velcro fastener is attached to the opposing surfaces of the strap such that the strap can be retained in the desired position when the end thereof is drawn through ring 22 to hold the wearer's heel securely to the sandal. Side strap 30 is fixedly attached at one end to post member 15 and at the other end to post member 20*a* to provide side support for the wear's foot. Thus, the sandal can be adjusted to accommodate foot dimensions as well as the use of the sandal either bare footed or with socks or booties on the user's foot. Such adjustment is achieved in the toe area without the use of any exposed "hardware" which might cause discomfort or injury or which would be subject to breakage.

While the invention has been described and illustrated in detail, it is to be clearly understood that this is intended by way of illustration and example only and is not to be taken by way of limitation, the spirit and scope of the invention being limited only by the terms of the following claims.

I claim:

1. A sandal having straps for securing said sandal to the foot of a wearer thereof comprising:

a sole, a toe strap assembly including:

an anchor member attached to one side of the toe portion of said sole, said anchor member having an upright portion with a slot formed therein, said sole having a first slotted portion in one side thereof in which the upright portion of the anchor member is fitted in a position recessed below the upper surface of said sole, a toe strap attached at one end thereof to the toe portion of said sole on the side thereof opposite to said one side thereof, the other end of said toe strap being wrapped over the portions of the wearer's foot immediately behind the toes and fitted through the slot of said anchor member, said strap being folder over on itself to bring first and second portions thereof into opposing relationship, and a fastener device which joins the opposing portions of the strap together with the toe strap wrapped securely over a portion of the wearer's foot directly behind the toes, and a heel strap assembly including a ring member attached to one side of the heel portion of the sole, a first heel strap attached at one end thereof to the side of the heel portion of the sole opposite to said one side thereof, the other end of said first heel strap being wrapped over the portion of the wearer's foot directly behind the instep and fitted through said ring member and folded over on itself to bring two portions thereof into opposing relationship, a fastener device which joins said two opposing portions of the first heel strap together with said first heel strap wrapped securely around the portion of the wearer's foot directly behind the instep, a second heel strap attached at one end thereof to the side of the heel portion of the sole opposite to that to which the ring member is attached, the other end of said second heel strap member being wrapped around the wearer's heel and fitted through said ring member and folded over on itself to bring two portions thereof into opposing relationship, and a fastener device which joins said opposing portions of said second heel strap together with said second heel strap wrapped securely around the wearer's heel.

2. The sandal of claim 1 wherein said sole comprises separate insole and outsole portions joined together.

3. The sandal of claim 2 wherein said anchor member is attached to the undersurface of said insole portion, the slotted portion through which the upright portion of the anchor member is fitted being formed in said insole.

4. The sandal of claim 1 and further including a side strap attached at one end to the end of said toe strap attached to said sole and at the other end thereof to the ends of said heel straps attached to the sole.

5. The sandal of claim 1 where the fastener devices for joining the opposing portions of the straps together comprises hook-loop fasteners.

6. A sandal having straps for securing said sandal to the foot of a wearer thereof comprising:

an insole and an outsole joined together to form a unitary sole;

a toe strap assembly including an anchor member attached to the under surface of the toe portion of said insole, said anchor member having an upright portion with a slot formed therein, said insole having a first slotted portion extending through one side thereof, said upright portion of the anchor member being fitted in said first slotted portion in a position recessed beneath the top surface of said insole, a first post member fixedly attached to the under surface of said insole, said insole having a second slotted portion extending therethrough on the side of said insole opposite to said one side thereof, said post member being fitted through said second slotted portion and extending upwardly from the top surface of said insole, and a toe strap attached at one end thereof to said first post member, the other end of said toe strap being fitted through the slot in the upstanding portion of said anchor member, said strap being folded over on itself to bring first and second portions thereof into opposing relationship, one of said strap portions having the hook part and the other of said portions having the loop part of a hook-loop fastener attached thereto, said toe strap being wrapped securely over a portion of the wearer's foot directly behind the toes and retained in this position by said hook-loop fastener.

a heel strap assembly including second and third post members attached to the under surface of the heel portion of said insole, a pair of slots being formed on opposite sides of the heel portion of said insole, said second and third post members each extending through one of said slots and protruding upwardly from the outer surface of said insole, said third post member having a loop formed therein, a ring member installed in the loop of said third post member, a first heel strap attached at one end thereof to said second post member, the other end of said first heel strap being fitted through said ring member and folded over on itself to bring two portions thereof into an opposing relationship, one of said strap portions having the hook part and the other of said strap portions having the loop part of a hook-loop fastener attached thereto, said first heel strap being wrapped securely around a portion of the wearer's foot directly behind the instep and retained securely in this position by the hook-loop fastener, a second heel strap attached at one end thereof to said second post member, the other end of said second heel strap being fitted through said ring member and folded over on itself to bring two portions thereof in opposing relationship, one of said second heel strap portions having the hook part and the other of said portions having the loop part of a hook-loop fastener affixed said portions having the loop part of a hook-loop fastener affixed thereto, said second heel strap being wrapped securely around the back of the wearer's heel and retained in this position by the hook-loop fastener, and side strap fixedly attached at one end thereof to the post member of said toe strap and the other end thereof to the first post member of said heel strap, whereby said toe strap and said heel strap are independently adjustable to secure the toe and heel portions of the wearer's foot to the sandal respectively.

* * * * *